US006905652B2

(12) United States Patent
Ulfvin et al.

(10) Patent No.: US 6,905,652 B2
(45) Date of Patent: Jun. 14, 2005

(54) AUSTENITIC ALLOY

(75) Inventors: Charlotte Ulfvin, Gävle (SE); Bertil Waldén, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/861,522

(22) Filed: May 22, 2001

(65) Prior Publication Data

US 2002/0021980 A1 Feb. 21, 2002

(30) Foreign Application Priority Data

May 22, 2000 (SE) ..... 0001921

(51) Int. Cl.[7] ..... C22C 30/00
(52) U.S. Cl. ..... 420/586.1
(58) Field of Search ..... 420/586.1, 46, 420/40

(56) References Cited

U.S. PATENT DOCUMENTS

| | | | | |
|---|---|---|---|---|
| 2,214,128 A | | 9/1940 | Fontana et al. | |
| 4,302,247 A | * | 11/1981 | Abe et al. | 420/46 |
| 4,400,345 A | | 8/1983 | Pierart et al. | |
| 4,765,957 A | * | 8/1988 | Culling | 420/586.1 |
| 4,876,065 A | | 10/1989 | Rockel et al. | |
| 5,480,609 A | * | 1/1996 | Dupoiron et al. | 420/45 |
| 5,866,065 A | * | 2/1999 | Herbelin et al. | 420/40 |

FOREIGN PATENT DOCUMENTS

| | | |
|---|---|---|
| JP | 60224763 A | 4/1986 |
| JP | 5247597 A | 9/1993 |
| JP | 6136442 A | 8/1994 |

OTHER PUBLICATIONS

Manufacturing Engineering and Technology, 4th ed., Kalpakjian and Schmid, 2001, Prentice Hall, Especially pp. 144–145.*

* cited by examiner

*Primary Examiner*—Deborah Yee
(74) *Attorney, Agent, or Firm*—Burns, Doane, Swecker & Mathis, L.L.P.

(57) ABSTRACT

An austenitic alloy with the following composition, in weight-%:

| | |
|---|---|
| Cr | 23–30 |
| Ni | 25–35 |
| Mo | 3–6 |
| Mn | 1–6 |
| N | 0–0.40 |
| C | up to 0.05 |
| Si | up to 1.0 |
| S | up to 0.02 |
| Cu | up to 3.0 |

and the balance iron and normally occurring impurities and additions.

19 Claims, 5 Drawing Sheets

AUSTENITIC ALLOY

This application claims priority under 35 U.S.C. §§ 119 and/or 365 to 0001921-6 filed in Sweden on May 22, 2000; the entire content of which is hereby incorporated by reference.

BACKGROUND OF THE INVENTION

The present invention relates to an austenitic stainless steel alloy with high contents of Cr, Mo, Mn, N and Ni for applications within areas where a combination of good corrosion resistance are required, for example against normally occurring substances under oil and gas extraction, as well as good mechanical properties, such as high strength and fatigue-resistance. It should be possible to use the steel alloy for example within the oil and gas industry, in flue gas cleaning, seawater applications and in refineries.

Austenitic stainless steels are steel alloys with a single-phase crystal structure, which is characterized by a face-centered cubic-lattice structure. Modern stainless steels are primarily used in applications within different processing industries, where mainly requirements regarding to corrosion resistance are of vital importance for the selection of the steel to be used. A characteristic of the stainless austenitic steels is that they all have their maximum temperature in the intended application areas. In order to increase applicability in difficult environments, alternatively at higher temperatures, higher contents of alloying elements such as Ni, Cr, Mo and N been added. Primarily the materials have been used in annealed condition, where yield point limits of 220–450 MPa have been usual. Examples of high alloyed stainless austenitic steels are UNS S31254, UNS N08367, UNS N08926 and UNS S32654. Even other elements, such as Mn, Cu, Si and W, occur either such as impurities or in order to give the steels special properties.

The alloying levels in those austenitic steels are limited upwards by the structural stability. The austenitic stainless steels are sensitive for precipitation of intermetallic phases at higher alloying contents in the temperature range 650–1000° C. Precipitation of intermetallic phase will be favored by increasing contents of Cr and Mo, but can be suppressed by alloying with N and Ni. The Ni-content is mainly limited by the cost aspect and because it strongly decreases the solubility of N in the Smelt. The content of N is consequently limited by the solubility in the smelt and also in solid phase where precipitation of Cr-nitrides can occur.

In order to increase the solubility of N in the smelt, the content of Mn and Cr can be increased as well as the content of Ni can be reduced. However, Mo has been considered to cause an increased risk of precipitation of intermetallic phase and for this reason it has been considered being necessary to limit this content. Higher contents of alloying elements have not only been limited by considerations regarding the structural stability. Even the hot ductility during the production of steel billets has been a problem for subsequent working.

An interesting application of stainless steel is in plants for the extraction of oil/gas or geothermal heat. The application puts high demands on the material due to the very aggressive substances hydrogen sulfide and chlorides, in different conditions dissolved in the produced liquids/gases, such as oil/water or mixtures thereof at very high temperatures and pressure. Stainless steels are used here in large degree both as production tube and so-called wirelines/slicklines down in the sources. The degree of resistance against chloride induced corrosion of the materials, $H_2S$-induced corrosion or combinations thereof can be limiting for their use. In other cases, the use is limited in larger degree by the fatigue-resistance due to repeated use of the alloy as wireline/slickline and from the bending of the wire over a so-called pulley wheel. Further, the possibilities to use the material within this sector are limited by the permitted failure load of wireline/slickline-wires. Today the failure load will be maximized by use of cold-formed material. The degree of cold deformation will usually be optimized with regard to the ductility. Corresponding requirement profiles can be needed for strip- and wire-springs, where high requirements on strength, fatigue- and corrosion properties occur.

Usually occurring materials within this sector for use in corrosive environments are UNS S31603, duplex steels, such as UNS S31803, which contains 22% Cr, UNS S32750, which contains 25% Cr, high alloyed stainless steels, such as UNS N08367, UNS S31254 and UNS N08028. For more aggressive environments, exclusive materials such as high alloyed Ni-alloys with high contents of Cr and Mo and alternatively Co-based materials are used for certain applications. In all cases the use is limited upwards by reasons of corrosion and stress.

When considering a steel for use in these environments it is well-known that Cr and Ni increase the resistance to $H_2S$-environments, while Cr, Mo and N are favorable in chloride environments according to the well-known relationship PRE=% Cr+3.3% Mo+16% N. An optimization of an alloy has until now led to the contents of Mo and N being maximized in order to obtain the highest possible PRE-value in that way. Thus, in many of the presently existing modern steels the resistance to a combination of $H_2S$- and Cl-corrosion has not been given priority, but only in a limited extent been taken into account. Further, oil extraction today is being done to an increasing extent from sources becoming deeper and deeper. At the same time the pressure and temperature increase (so called High-pressure, High temperature Fields). Increased depth leads of course to an increased dead weight during use of free hanging materials, whether these concerns so called wirelines or pipe tracks. Increasing pressure and temperature leads to the corrosion conditions aggravating so that the requirements on the existing steel increase. For wirelines, there are also requirements to increase the yield point in tension since there occurs plasticity on the surface of the existing materials at the presently used sizes of pulley wheels. Tension stresses up to 2000 MPa exist in the surface layer, which is considered strongly contributing to the short lifetime, that is obtained for wireline-alloys.

In the light of the above background, it is easy to identify a requirement for a new alloy, which combines both the resistance to chloride-induced corrosion and resistance to $H_2S$-corrosion for applications particularly in the oil and gas industry, but also within other application areas. Further, there exist demands on significantly higher strength than today's technique achieves at a given range of cold-deformation. As strength is wanted which leading to that normally occurring dimensions of wire do not plastify on the surface or allowing the use of smaller dimensions is desired.

In U.S. Pat. No. 5,480,609, an austenitic alloy is described, which according to claim 1 contains iron and 20–30% chromium, 25–32% nickel, 6–7% molybdenum, 0.35–0.8% nitrogen, 0.5–5.4% manganese, highest 0.06% carbon, highest 1% silicon, all counted on the weight, and which exhibits a PRE-number of at least 50. Optional components are copper (0.5–3%), niobium (0.001–0.3%), vanadium (0.001–0.3%), aluminum (0.001–0.1%) and boron (0.0001–0.003%). In the only practical example 25% chromium, 25.5% nickel, 6.5% molybdenum, 0.45% nitrogen, 1.5% copper, 0.020% carbon, 0.25% silicon and 0.001% sulfur, balance iron and impurities were used. This steel exhibits good mechanical properties, but has not sufficiently good properties to fulfill the purposes according to the present invention.

OBJECTS AND SUMMARY OF THE INVENTION

It is an object of this invention to avoid or alleviate the problems of the prior art.

It is further an object of this invention to provide an austenitic stainless steel alloy for applications within areas where a combination of good corrosion resistance and good mechanical properties is required.

It is an aspect of the invention to provide an austenitic alloy comprising the following in weight %:

| | |
|---|---|
| Cr | 23–30 |
| Ni | 25–35 |
| Mo | 3–6 |
| Mn | 1–6 |
| N | 0–0.40 |
| C | up to 0.05 |
| Si | up to 1.0 |
| S | up to 0.02 |
| Cu | up to 3.0 |

the balance iron and normally occurring impurities and additions.

DETAILED DESCRIPTION OF THE PREFERRED EMBODIMENTS OF THE INVENTION

Figure 1:
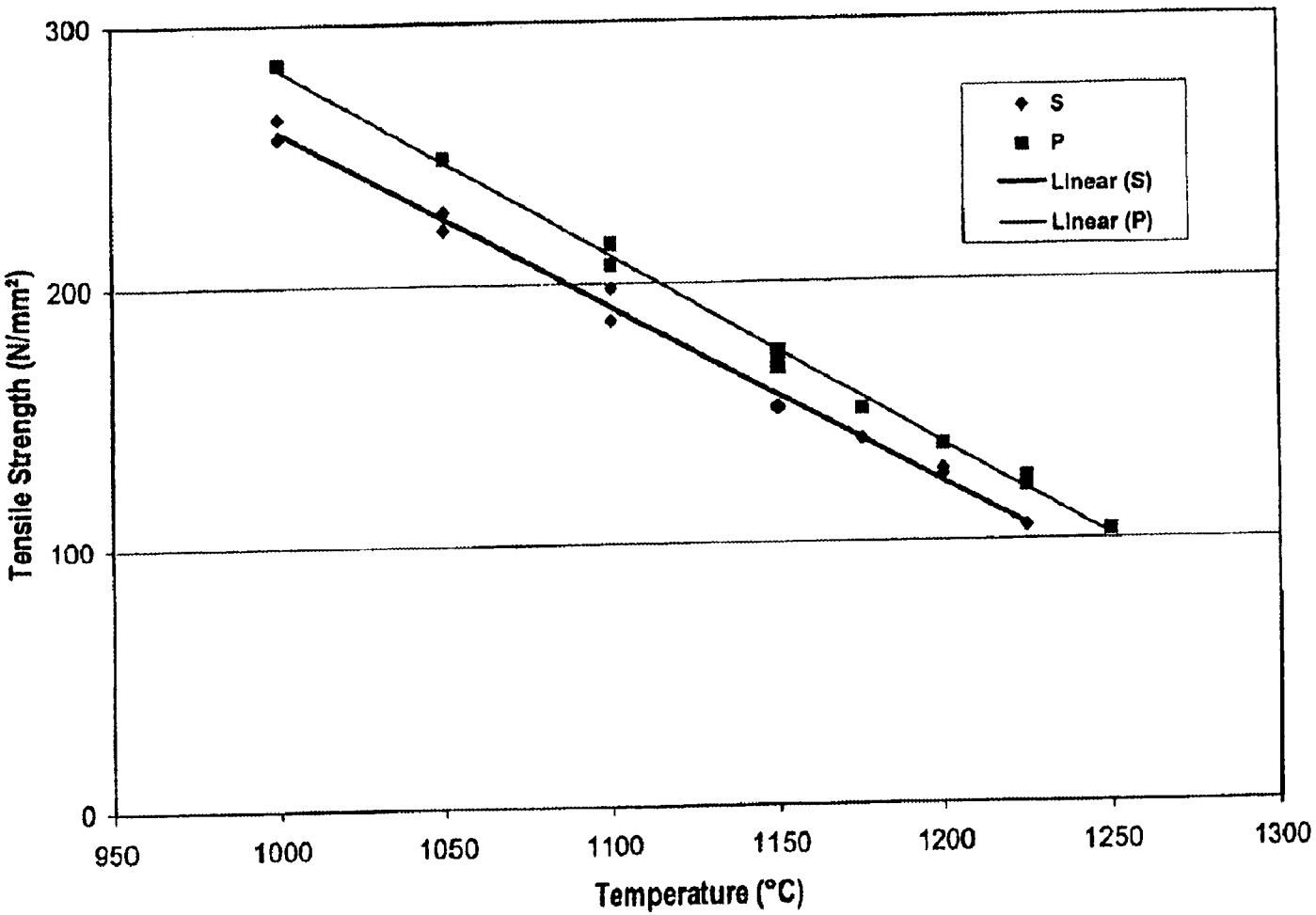
FIG. 1 shows the plot of the tension against the temperature under hot working for the embodiments S and P of the present invention.

The present invention relates consequently to an austenitic stainless steel alloy, which fulfills the above mentioned demands. The alloy according to the invention contains, in weight-%:

| | |
|---|---|
| Cr | 23–30 |
| Ni | 25–35 |
| Mo | 3–6 |
| Mn | 1–6 |
| N | 0–0.4 |
| C | up to 0.05 |
| Si | up to 1.0 |
| S | up to 0.02 |
| Cu | up to 3 |

and the balance Fe and normally occurring impurities and additions.

The content of nickel should preferably be at least 26 weight-%, more preferably at least 28 weight-% and most preferably at least 30 or 31 weight-%. The upper limit for the nickel content is suitably 34 weight-%. The content of molybdenum can be at least 3.7 weight-% and is suitably at least 4.0 weight-%. Particularly, it is highest 5.5 weight-%. A suitable content of manganese is more than 2 weight-%, preferably the content is 3–6 weight-% and then specially 4–6 weight-%. The content of nitrogen is preferably 0.20–0.40, more preferably 0.35–0.40 weight-%. The content of chromium is suitably at least 24. Particularly favorable results will be obtained at a chromium content of highest 28 weight-%, particularly highest 27 weight-%. The content of copper is preferably highest 1.5 weight-% .

In the alloy in question it is possible to replace the amount of molybdenum partly or completely by tungsten. However, the alloy should preferably contain at least 2 weight-% of molybdenum.

The alloy according to the invention can contain a ductility addition, consisting of one or more of the elements Mg, Ce, Ca, B, La, Pr, Zr, Ti, Nd, preferably in a total amount of highest 0.2% .

The importance of the alloying elements to the present invention is as follows:

Nickel 25–35 Weight-%

A high content of nickel homogenizes highly alloyed steel by increasing the solubility of Cr and Mo. The austenite stabilizing nickel suppresses therewith the formation of the undesirable sigma-, laves- and chi-phases, which to a large extent consist of the alloying elements chromium and molybdenum.

Nickel does not only act as counter part to the precipitation disposed elements chromium and molybdenum, but also as an important alloying element for oil/gas-applications, where the occurrence of hydrogen sulfide and chlorides is usual. High stresses in combination with a tough environment can cause stress corrosion "stress corrosion cracking" (SCC), which often is referred to as "sulfide stress corrosion cracking" (SSCC) in the mentioned environments.

The alloy is based on high contents of nickel and chromium since the synergistic effect of them has been considered being more decisive than a high concentration of molybdenum regarding the resistance to SCC in anaerobic environments with a mixture of hydrogen sulfides and chlorides.

A high nickel content has also been considered being favorable against general corrosion in reducing environments, which is advantageous regarding the environment in oil and gas sources. An equation based on the results of the corrosion testing has been derived. The equation predicts the corrosion rate in a reducing environment. The alloy should suitably fulfill the requirement:

$$10^{(2.53-0.098\times[\%\ Ni]-0.024\times[\%\ Mn]+0.034\times[\%\ Cr]-0.122\times[\%\ Mo]+0.384\times[\%\ Cu]}<1.5$$

However, a disadvantage is that nickel decreases the solubility of nitrogen in the alloy and deteriorates the hot workability, which causes an upper limitation for the alloying content of nickel.

The present invention has shown, however, that a high content of nitrogen can be permitted according to the above by balancing the high content of nickel with high contents of chromium and manganese.

Chromium 23–30 Weight-%

A high content of chromium is the basis for a corrosion resistant material. A fast way to rank material for pitting corrosion in chloride environment is to use the mostly applied formula for the "pitting resistant equivalent" (PRE)=[% Cr]+3.3×[% Mo]+16×[% N], where even the positive effects of molybdenum and nitrogen become evident. There are a lot of different variants of the formula for PRE, particularly it is the factor for nitrogen which differs from formula to formula, sometimes there is also manganese as an element which decreases the PRE-number. A high PRE-number indicates a high resistance to pitting corrosion in chloride environments. Only the nitrogen that is dissolved in the matrix has a favorable influence, in difference to nitrides for example. Undesirable phases, such as nitrides can instead act as initiation points for corrosion attacks, for that reason chromium is an important element by its property of increasing the solubility of nitrogen in the alloy. The following formula gives an indication about the resistance of the alloy to pitting corrosion. The higher the value, the better. It has been seen that this formula better predicts the corrosion resistance of the alloy than the classical PRE-formula. The formula explains also, why preferably a high content of chromium is of importance in the present invention in difference to the state of the art. Instead of a difference of the factor 3.3 between molybdenum and chromium (according to the classical PRE-formula) the corresponding factor becomes 2.3 according to the following formula. A comparison between the pitting temperature for the new alloy and UNS N08926, UNS S31254, both with high contents of molybdenum, and UNS N08028 are presented in the Example 1.

$$93.13-3.75\times[\%\ Mn]+6.25\times[\%\ Cr]+5.63\times[\%\ N]+14.38\times[\%\ Mo]-2.5\times[\%\ Cu]$$

Chromium has, as mentioned before, besides the influence against pitting corrosion, a favorable influence against SCC in connection with hydrogen sulfide attacks. Further, chromium exhibits a positive influence in the Huey-test, which reflects the resistance to intergranular corrosion, i.e. corrosion, where low-carbon (C<0.03 weight-%) material is sensitized by a heat treatment at 600–800° C. The present alloy has proven to be highly resistant. Preferred embodiments according to the invention fulfill the requirement:

$$10\hat{}(-0.441-0.035\times[\%\ Cr]-0.308\times[\%\ N]+0.073\times[\%\ Mo]+0.022\times[\%\ Cu])\leqq 0.10$$

Particularly preferred alloys have an amount of ≦0.09.

In difference to chromium, molybdenum increases the corrosion rate. The explanation is the tendency to precipitation of molybdenum, which gives rise to undesirable phases during sensitizing. Consequently a high content of chromium is chosen in favor of a really high content of molybdenum, but also in order to obtain an optimum structural stability for the alloy. Certainly, both alloying elements increase the tendency to precipitation, but tests show that molybdenum has twice the effect of chromium. In an empirically derived formula for the structural stability, according to the following, has molybdenum a more negative influence than chromium. The alloy according to the invention preferably fulfills the requirement:

$$-8.135-0.16\times[\%\ Ni]+0.532\times[\%\ Cr]-5.129\times[\%\ N]+0.771\times[\%\ Mo]-0.414\times[\%\ Cu]<4$$

Molybdenum 3–6 Weight-%

A larger addition of molybdenum is often made to modern corrosion resistant austenites in order to increase the resistance to corrosion attacks in general. For example, its favorable effect on the pitting corrosion in chloride environments has earlier been shown by the well-known PRE-formula, a formula that has been of guidance for today's alloys. Also in the present invention, a favorable effect of molybdenum on the corrosion resistance is readable in formulas developed particularly for the behavior of this invention at erosion in reducing environment and at pitting in chloride environment. According to the previous formula for pitting corrosion, it is important to accentuate that the influence of molybdenum on chloride induced corrosion has not shown as powerful as the state of the art has manifested it hitherto. It is acquired by experience and known that synergies of high contents of nickel and chromium are more decisive regarding to resistance to stress corrosion in an anaerobe environment with a combination of hydrogen sulfides and chlorides than a high content of molybdenum.

The tendency to precipitation of molybdenum gives a negative effect on the intergranular corrosion (oxidizing environment), where the alloying element is bound instead of in the matrix. The alloy according to the invention combines a very high resistance to pitting corrosion with resistance to acids, which makes it ideal for heat exchangers in the chemical industry. The resistance of the alloy to acids (reducing environment) is described with the following formula for general corrosion. The alloy should preferably fulfill the requirement:

$$10\hat{}(3.338+0.049\times[\%\ Ni]+0.117\cdot\times[\%\ Mn]-0.111\times[\%\ Cr]-0.601\times[\%\ Mo])\leqq 0.50$$

A clear increase in the hardness can be understood from diagrams, which show the necessary stress during heat treatment for variants of the alloy with high respective low content of molybdenum. The negative influence of molybdenum on the necessary stress during hot working is shown in FIG. 1 by the alloying variants S and P. The necessary stress is directly proportional to the necessary load, which is measured when the area of the test specimen is unaffected, i.e. directly before the necking. The stress is calculated from the relationship:

$$\sigma=F/A$$

σ: tension [N/mm$^2$]

F: force [N]

A: area [mm$^2$](=fixed)

Decreased structural stability and processing properties make that the content of molybdenum of the alloy, despite its often favorable influence on the resistance to corrosion of the alloy, will be limited to maximum 6%, preferably maximum 6.0 weight-%.

Manganese 1.0–6.0 Weight-%

Manganese is of vital importance for the alloy because of three reasons. For the final product a high strength will be aimed at because the alloy should be strain hardened during cold working. Both nitrogen and manganese are known for decreasing the stacking-failure energy, which in turn leads to that dislocations in the material dissociate and form Shockley-partials. The lower the stacking-fault the greater the distance between the Shockley-partials and the more aggravated the sideslipping of the dislocations will be which makes that the material get great to strain harden. On these grounds are high contents of Manganese and Nitrogen very important for the alloy. A rapid strain hardening will be visualized in the reduction graphs, which will be presented in FIG. 3, where the new alloy will be compared with the already known steels UNS N08926 and UNS N08028.

Furthermore, manganese increases the solubility of nitrogen in the smelt, which further speaks in favor of a high content of manganese. Solely the high content of chromium does not make the solubility sufficient since the content of nickel, which decreases the nitrogen solubility, was chosen higher than the content of chromium. The solubility of nitrogen of the alloy can be predicted thermodynamically with the formula below. A positive factor for manganese, chromium and molybdenum is shown by their increasing effect on the solubility of nitrogen.

$$-1.3465+0.0420\times[\%\ Cr]+0.0187\times[\%\ Mn]+0.0103\times[\%\ Mo]-0.0093\times[\%\ Ni]-0.0084\times[\%\ Cu]$$

The value should suitably be greater bigger than −0.46 and less than −0.32.

A third motive for a content of manganese in the range for the present invention is that a yield stress analysis was made at elevated temperature surprisingly has shown the improving effect of manganese on the hot workability of the alloy. The more high alloyed the steels become, the more difficult they will be worked and the more important additions for the workability improvement become, which both simplify and make the production cheaper. An addition of manganese involves a decreasing of the hardness during hot working, which gathers from the diagram of FIG. 2, which shows the necessary strain during hot working for variants of the alloy with high and low content of manganese respectively. The positive effect of manganese on the necessary tension during hot working is demonstrated here of the variants X and P of the alloy. The necessary tension is directly proportional to the necessary force, which is measured when the specimen area is unaffected, i.e. directly before the necking. The tension is be calculated from the relationship:

$$\sigma=F/A$$

σ: tension [N/mm$^2$]

F: force [N]

A: area [mm$^2$](=fixed)

The good hot workability makes the alloy excellent for the production of tubes, wire and strip etc. However, there was found a weakly negative effect of manganese on the hot ductility of the alloy, as described in the formula below.

Its powerful positive effect as a hardness decreasing alloying element during hot working has been estimated as more important. The alloy has suitably a composition, which gives a value of at least 43 for the following formula, preferably a value of at least 44.

$$10\hat{}(2.059+0.00209\times[\%\ Ni]-0.017\times[\%\ Mn]+0.007\times[\%\ Cr]-0.66\times[\%\ N]-0.056\times[\%\ Mo])$$

Manganese has appeared being an element that decreases the resistance to pitting corrosion of the alloy in chloride environment. By balancing the corrosion and the workability an optimum content of manganese for the alloy has been chosen.

The alloy has preferably a composition that a firing limit higher than 1230 is obtained according to the following formula:

$$10\hat{}(3.102-0.000296\times[\%\ Ni]-0.00123\times[\%\ Mn]+0.0015\times[\%\ Cr]-0.05\times[\%\ N]-0.00276\cdot\times[\%\ Mo]-0.00137\times[\%\ Cu])$$

Nitrogen 0–0.4 Weight-%

Nitrogen is as well as molybdenum a popular alloying element in modern corrosion resistant austenites in order to increase the resistance to corrosion, but also the mechanical strength of an alloy. For the present alloy it is foremost the increasing of the mechanical strength by nitrogen, which will be exploited. As mentioned above, a powerful increase in strength is obtained during cold deformation as manganese lowers the alloy stacking-fault energy. The invention exploits also that nitrogen increases the mechanical strength of the alloy as consequence of interstitial soluted atoms, which cause stresses in the crystal structure. A high strength is of fundamental importance for the intended applications as sheets, heat exchangers, production tubes, wire- and strip springs, rigwire, wirelines and also all sorts of medical applications. By using a high tensile material the possibility is given to obtain the same strength, but with less material and thereby less weight. For springs their tendency for absorbing elastic energy is of decisive importance. The amount of elastic energy that springs can storage is according to the following relationship $$W=\text{const}\times\frac{\sigma^2}{E}\ \text{for springs with flexural stress}$$

$$W=\text{const}\times\frac{\tau^2}{G}\ \text{for springs with shearing stress}$$

where σ represents the limit for the elasticity at flexural stress, in practice the yield point in tension of the material, E represents the elasticity module and G represents the shearing module.

The constants depend on the shape of the spring. Independent of flexural or shearing stress, the possibility for storing of a high elastic energy with high yield point in tension and low elastic and shearing module respectively will be obtained. By reason of the difficulties to measure the elastic module on wire coiled on a spool with a certain curvation, a value, valid for UNS N08926 has been assumed from the literature for all mentioned alloys.

TABLE 1

| | Ø (mm) | $R_{p0.2}$ (N/mm$^2$) | E (N/mm$^2$) | W |
|---|---|---|---|---|
| New alloy variant B | 3.2 | 1590 | 198 000 | constant × 12.8 |
| New alloy variant C | 3.2 | 1613 | 198 000 | constant × 13.1 |
| New alloy variant E | 3.2 | 1630 | 198 000 | constant × 13.4 |
| UNS N08028 | 3.2 | 1300 | 198 000 | constant × 8.5 |
| UNS N08926 | 3.2 | 1350 | 198 000 | constant × 9.2 |

Nitrogen has also a favorable effect on the resistance to pitting corrosion such as shown above.

As far as the structural stability is concerned, nitrogen can act in both a positive stabilizing direction as well as in a negative direction by causing chromium nitrides.

Copper 0–3 Weight-%

The effect of an addition of copper on the corrosion properties of austenitic steel is disputed. However, it seems clear that copper powerfully increases the resistance to corrosion in sulfuric acid, which is of big importance for the field of application of the alloy. Copper has during testing shown to be an element that is favorable for the production of tubes, for what reason an addition of copper is particularly important for material produced for tube applications. However, acquired by experience it is known that a high content of copper in combination with a high content of manganese powerfully decreases the hot ductility, for what reason the upper limit for copper is determinated to 3 weight-%. The content of copper is preferably highest 1.5 weight-%.

The invention is additionally illustrated in connection with the following Examples which are to be considered as illustrative of the present invention. It should be understood, however, that the invention is not limited to the specific details of the Examples.

EXAMPLES

In the following tables the composition for the tested alloys according to the invention and for some well-known alloys, which are mentioned above, is given.

For the well-known alloys the range which defines the composition for testing is given for those cases, where they were used for testing.

TABLE 2

| Designation | C | Si | Mn | Cr | Ni | Mo | Cu | N |
|---|---|---|---|---|---|---|---|---|
| A | 0.009 | 0.28 | 5.04 | 26.4 | 30.49 | 5.78 | 0.025 | 0.372 |
| B | 0.011 | 0.27 | 5.1 | 26.5 | 33.7 | 5.9 | 0.011 | 0.38 |
| C | 0.008 | 0.27 | 4.95 | 26.7 | 30.77 | 5.22 | 0.011 | 0.357 |
| E | 0.01 | 0.28 | 4.73 | 27.2 | 30.69 | 4.47 | 0.011 | 0.354 |
| I | 0.015 | 0.22 | 1.03 | 27.71 | 34.86 | 3.97 | 0.5 | 0.41 |
| P | 0.015 | 0.24 | 1.07 | 26.91 | 30.77 | 6.41 | 1.18 | 0.22 |
| S | 0.015 | 0.22 | 5.57 | 26.11 | 30.3 | 6.2 | 1.15 | 0.2 |
| T | 0.017 | 0.26 | 2.97 | 26.18 | 30.87 | 5.86 | 1.16 | 0.29 |
| X | 0.0147 | 0.24 | 1.14 | 27.72 | 29.87 | 3.91 | 1.48 | 0.25 |

Example 1

Measurements of the pitting corrosion in 6 weight-% $FeCl_3$ were executed in accordance with ASTM G 48 on three alloys according to the invention and three comparative alloys. The highest possible temperature is 100° C. with regard to the boiling point of the solution.

TABLE 4

| | 60% cold worked test specimen, ground according to specification in ASTM G48 | Tube specimen produced with varying degree of cold working. As produced finish | Annealed test specimen, ground according to the specification in ASTM G48 |
|---|---|---|---|
| New Alloy A | >100° C.[1] | | |
| New Alloy I | 100° C.[1] | | |
| New Alloy T | 100° C.[1] | | |
| UNS N08028 | | 47° C.[2] | 55° C.[4] |
| UNS N08926 | | 67.5° C.[1] | |
| UNS S31254 | | 67.5° C.[3] | 87° C.[4] |

[1]Average of 2 tests
[2]Average of 12 tests
[3]Average of 22 tests
[4]Values from data sheet edited by Sandvik Steel and paper from Avesta Sheffield respectively.

Comparing the three different test finishes, cold worked test specimen, ground according to specification in ASTM G48, annealed test specimen, ground according to specification in ASTM G48 and tube specimen with existing surface, the highest temperature is expected to be attained for the annealed test specimen with ground surface. After that follow the cold worked test specimen with ground surface and the toughest test, where the lowest temperature will be expected, is where the test socket was made from the cold worked tubes with existing surface.

Example 2

Figure 2:
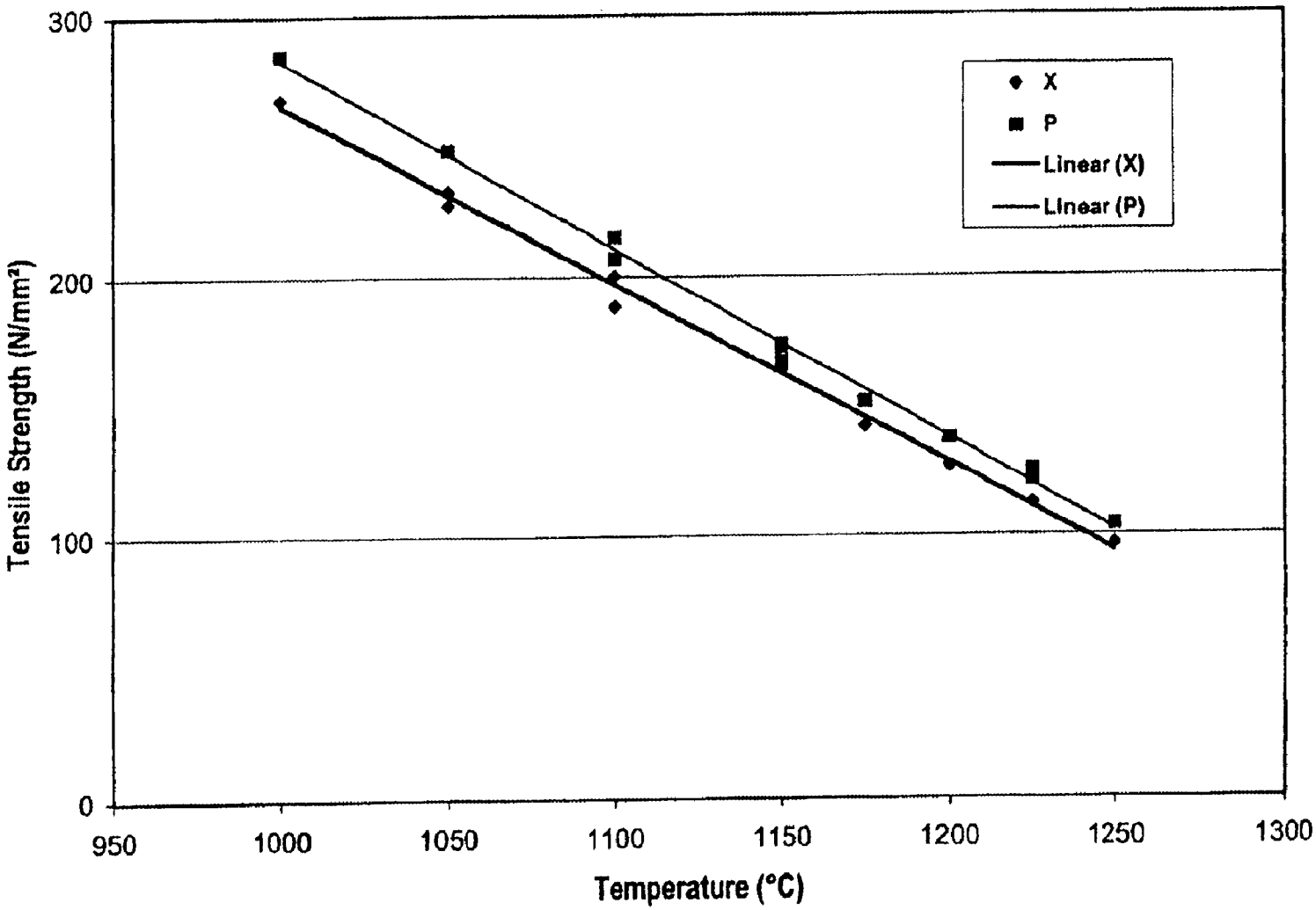
FIG. 2 shows the plot of the tension against the temperature under hot working for the embodiments X and P of the present invention.

The tension which is necessary for hot working the present alloy, at different contents of manganese and molybdenum, are shown in FIGS. 1 and 2. The negative effect of molybdenum on the necessary tension will be demonstrated of variant S and P in FIG. 1. The positive effect of manganese on the necessary tension will be demonstrated of variant X and P in FIG. 2.

Example 3

Figure 3:
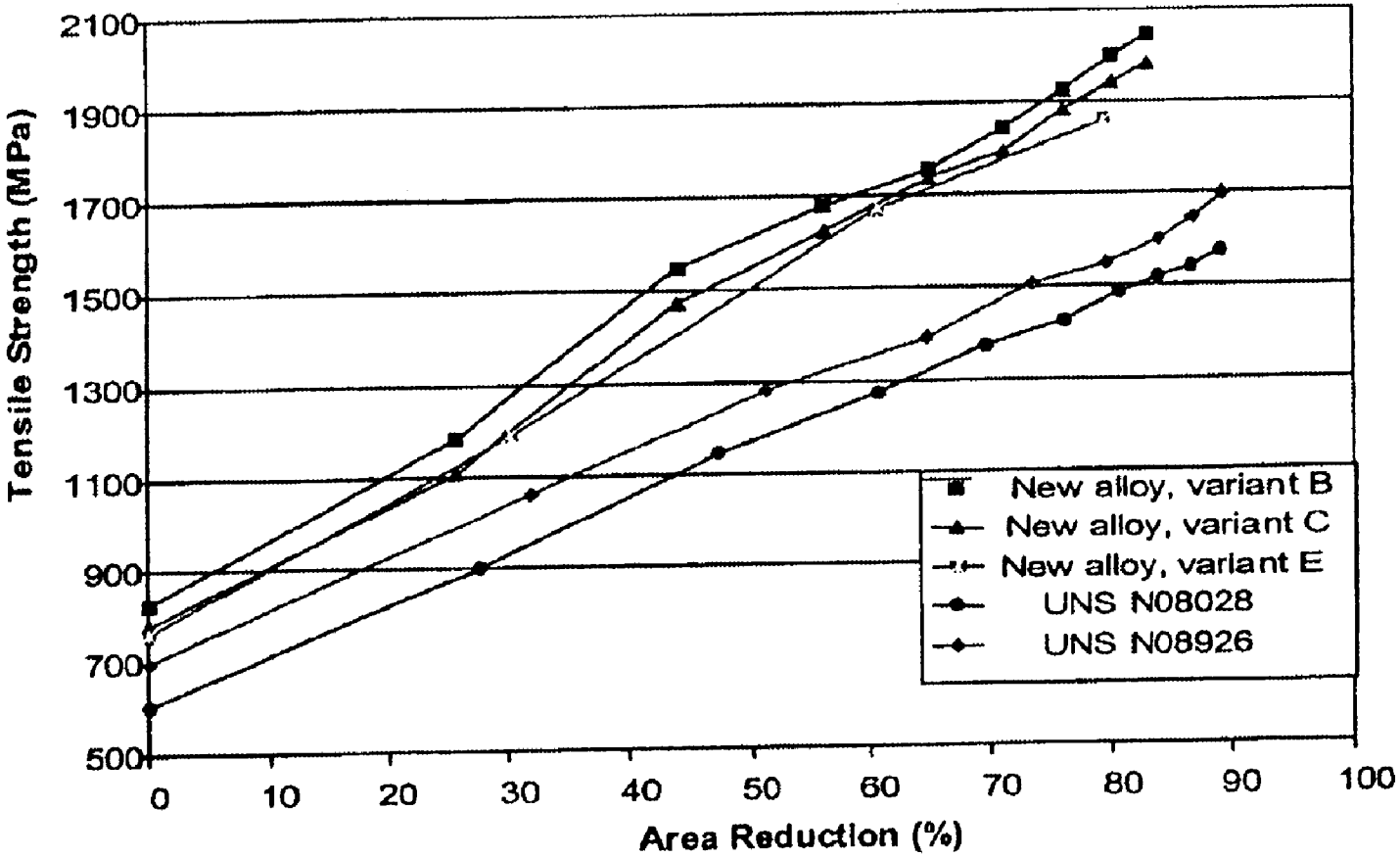
FIG. 3 shows a plot of the ultimate tensile strength against the reduction of the cross-section.

The substantially better increase in the ultimate stress at cold working of the present alloys, variants B, C, and E, in comparison with the well-known UNS N08028 and UNS N08926 are shown in FIG. 3.

TABLE 3

| Designation | C | Si | Mn | Cr | Ni | Mo | Cu | N |
|---|---|---|---|---|---|---|---|---|
| UNS N08028 | ≦0.02 | ≦1 | ≦2 | 27 | 30 | 3 | 1 | 0.06 |
| UNS N08926 | ≦0.02 | ≦1 | ≦1 | 20 | 25 | 6.5 | 1 | 0.2 |
| UNS S31254 | ≦0.02 | ≦0.08 | ≦1 | 19.5–20.5 | 17.5–18.5 | 6–6.5 | 0.5–1 | 0.18–0.22 |
| UNS N08367 | ≦0.03 | ≦1 | ≦2 | 20–22 | 23.5–25.5 | 6–7 | | 0.18–0.25 |
| UNS S32654 | ≦0.02 | ≦0.5 | 2–4 | 24–25 | 21–23 | 7–8 | 0.3–0.6 | 0.45–0.55 |
| UNS S31603 | ≦0.03 | ≦1 | ≦2 | 16–18 | 10–14 | 2–3 | | |
| UNS S31803 | ≦0.03 | ≦1 | ≦2 | 021–23 | 4.5–6.5 | 2.5–3.5 | | 0.1–0.2 |
| UNS S32750 | 0.03 | ≦0.8 | ≦1.2 | 24–26 | 6–8 | 3–5 | | 0.24–0.32 |

Example 4

Figure 4:
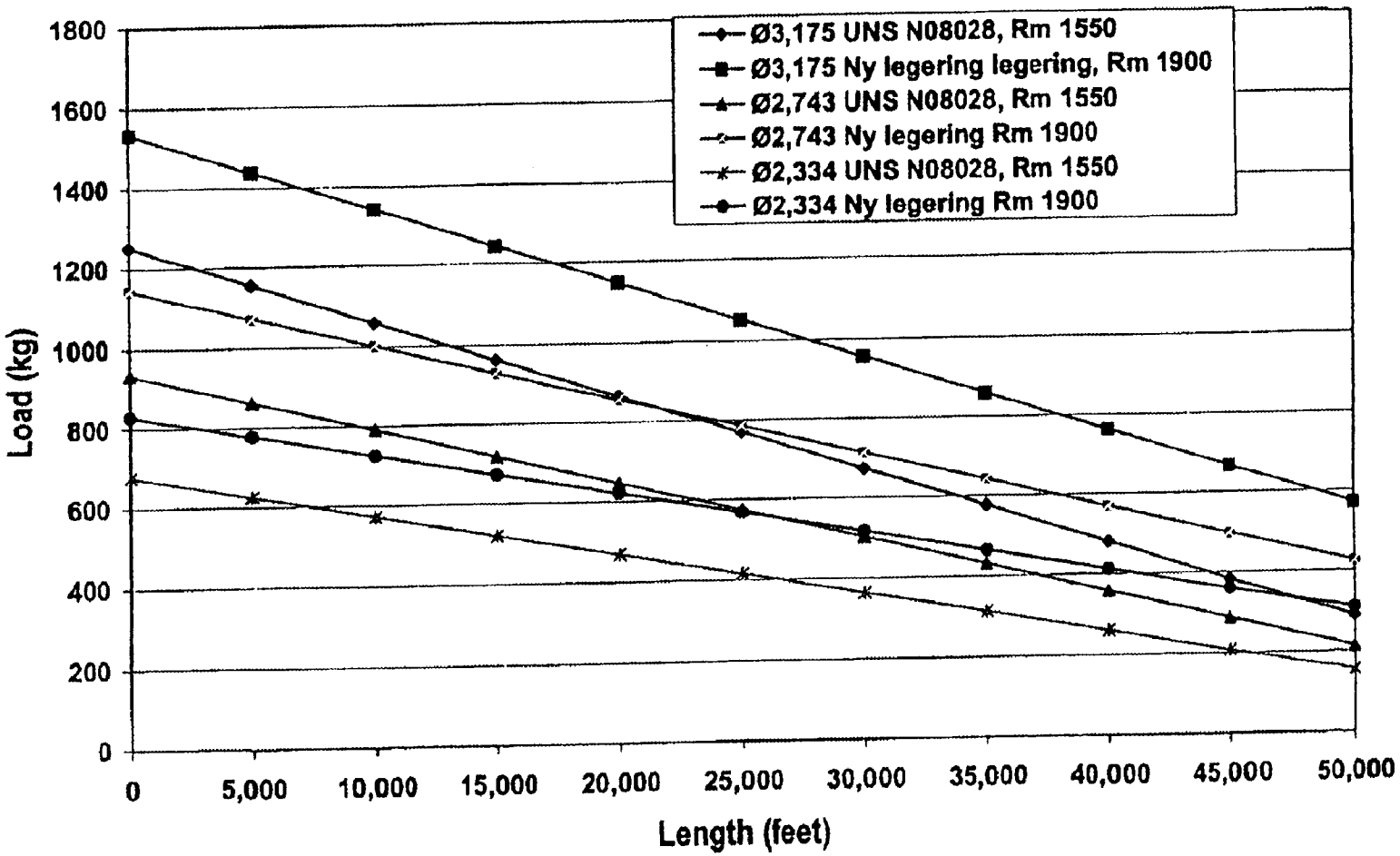
FIG. 4 shows the load as feature of the length of some embodiments of the present invention and some comparative examples.
Figure 5:
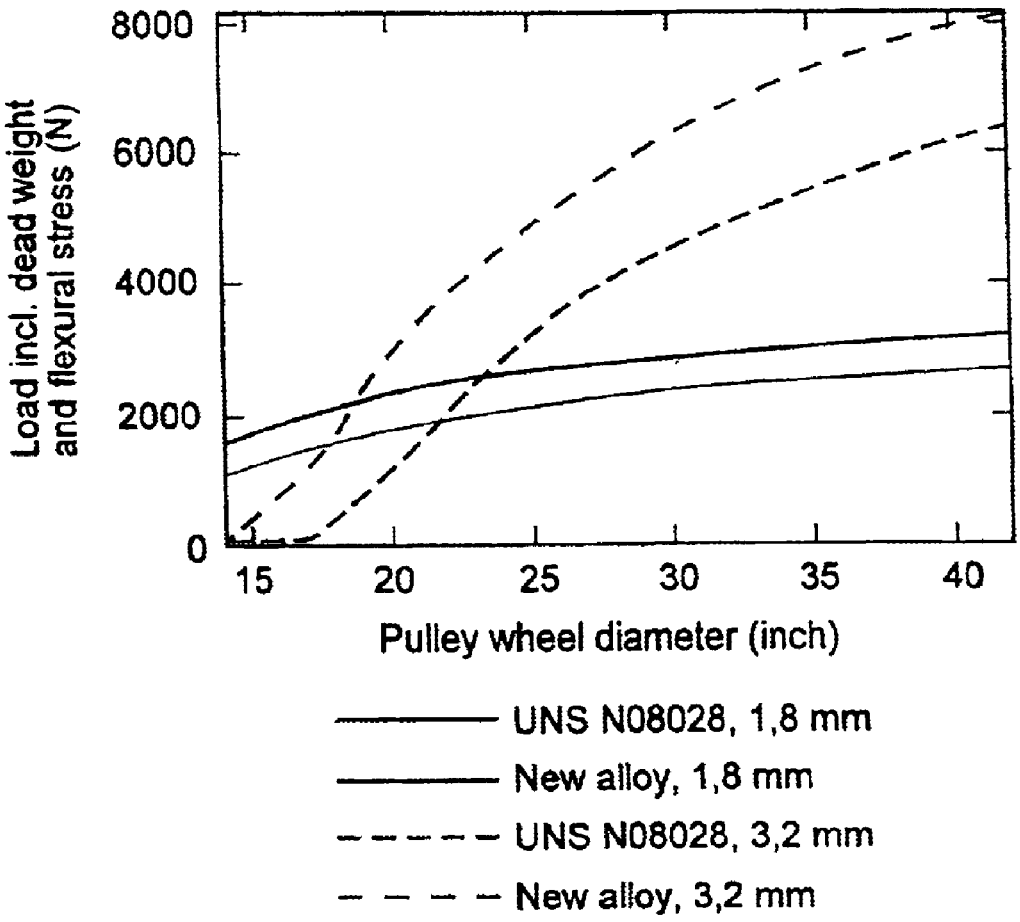
FIG. 5 shows the load including the dead weight and flexural stress vs. the diameter of the pulley wheel.

In the diagrams of FIGS. 4 and 5 the essential properties for wire and the application wirelines is visualized.

The diagram in FIG. 4 shows what load exceeding the dead weight a wire of the new alloy compared with a wire produced of the well-known alloy UNS N08028 can carry as a function of the length of the wire.

The density of the alloys has been estimated to $\sigma$=8 000 kg/m$^3$.

The acceleration of gravity has been approximated to g=9.8 m/s$^2$.

A long wire has an evident dead weight, which loads the wire. Normally this dead-weight will be carried by wheels with varying curvature, which furthermore gives rise to stresses for the wire. The smaller the curvation radius of the wheel is the higher the flexural stress for the wire becomes. At the same time a smaller wire diameter manages stronger curvation. The diagram of FIG. 5 shows what load inclusively the dead weight and flexural stress that the wire produced from the new alloy compared with the well-known alloy UNS N08028 can carry as a function of the pulley wheel diameter.

The elasticity module of both alloys have been estimated to E=198 000 MPa

The calculations for the diagram are made under the assumption that the stress drop is straight linear elastically and the maximum bearing load will be determined by the yield stress of the material (Rp0.2).

Example 5

In the following Table 5 the calculated values for the above-discussed relationships I–IX according to the following:

Structural stability=−8.135−0.16·[% Ni]+0.532·[% Cr]−5.129·[% N]+0.771·[% Mo]−0.414·[% Cu] I Hot ductility=10^(2.059+0.00209·[% Ni]−0.017·[% Mn]+0.007·[% Cr]−0.66·[% N]−0.056·[% Mo] II Firing limit=10^(3.102−0.000296·[% Ni]−0.00123·[% Mn]+0.0015·[% Cr]−0.05·[% N]−0.00276·[% Mo]−0.00137·[% Cu]) III General corrosion (acid resistance)=10^(3.338+0.049·[% Ni]+0.117·[% Mn]−0.111·[% Cr]−0.601·[% Mo]) IV General corrosion (reducing environments)=10^(2.53−0.098·[% Ni]−0.024·[% Mn]+0.034·[% Cr]−0.122·[% Mo]+0.384·[% Cu]) V Intergranular corrosion (oxidizing environments)=10^(−0.441−0.035·[% Cr]−0.308·[% N]+0.073·[% Mo]+0.022·[% Cu]) VI Pitting=93.13−3.75×[% Mn]+6.25×[% Cr]+5.63×[% N]+14.38×[% Mo]−2.5×[% Cu] VII PRE=[% Cr]+3.3×[% Mo]+16×[% N] VIII Nitrogen solubility=−1.3465+0.0420×[% Cr]+0.0187×[% Mn]+0.0103×[% Mo]−0.0093×[% Ni]−0.0084×[% Cu] IX In the Table the preferred values for the different correlations are also given.

TABLE 5

| Relation | A | B | C | E | I | P | S | T | X | Preferred Value |
|---|---|---|---|---|---|---|---|---|---|---|
| I | 3.57 | 3.17 | 3.34 | 3.05 | 1.78 | 4.58 | 4.19 | 3.40 | 2.95 | <4 |
| II | 44.94 | 44.36 | 49.90 | 56.13 | 65.37 | 61.56 | 53.85 | 54.54 | 81.68 | >43 |
| III | 1235.3 | 1230.8 | 1243.3 | 1252.7 | 1258.5 | 1263.7 | 1249.3 | 1248.0 | 1282.4 | >1230 |
| IV | 0.104 | 0.125 | 0.211 | 0.489 | 0.507 | 0.014 | 0.71 | 0.059 | 0.322 | ≦0.5 |
| V | 0.420 | 0.195 | 0.469 | 0.620 | 0.548 | 10188 | 1.000 | 1.133 | 4.066 | <1.5 |
| VI | 0.09 | 0.09 | 0.08 | 0.07 | 0.06 | 0.11 | 0.12 | 0.10 | 0.07 | ≦0.10 |
| VII | 324.4 | 326.6 | 318.5 | 311.6 | 320.6 | 347.8 | 322.8 | 328.6 | 316.0 | |
| VIII | 51.4 | 52.1 | 49.6 | 47.6 | 47.4 | 51.6 | 49.8 | 50.2 | 44.6 | >44 |
| IX | −0.368 | −0.391 | −0.365 | −0.355 | −0.451 | −0.426 | −0.373 | −0.428 | −0.411 | >−0.465 <−0.32 |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An austenitic alloy comprising:

a degree of structural stability such that

−8.135−0.16·[% Ni]+0.532·[% Cr]−5.129·[% N]+0.771·[% Mo]−0.414·[% Cu]<4;

a hot ductility such that

10^(2.059+0.00209·[% Ni]−0.017·[% Mn]+0.007·[% Cr]−0.66·[% N]−0.056·[% Mo])>43;

a firing limit such that

10^(3.102−0.000296·[% Ni]−0.00123·[% Mn]+0.0015·[% Cr]−0.05·[% N]−0.00276·[% Mo]−0.00137·[% Cu])>1230;

a corrosion resistance to an acidic environment such that

10^(3.338+0.049·[% Ni]+0.117·[% Mn]−0.111·[% Cr]−0.601·[% Mo])≦0.5;

a corrosion resistance to a reducing environment such that

10^(2.53−0.098·[% Ni]−0.024·[% Mn]+0.034·[% Cr]−0.122·[% Mo]+0.384·[% Cu])<1.5;

resistance to intergranular corrosion in oxidizing environments such that

10^(−0.441−0.035·[% Cr]−0.308·[% N]+0.073·[% Mo]+0.022·[% Cu])≦0.10;

a PRE value of

[% Cr]+3.3×[% Mo]+16×[% N]>44;

a nitrogen solubility such that

−1.3465+0.0420×[% Cr]+0.0187×[% Mn]+0.0103×[% Mo]−0.0093×[% Ni]−0.0084×[% Cu]is greater than −0.46 and less than −0.32; and wherein said alloy comprises in weight-%:

| | |
|---|---|
| Cr | 23–30 |
| Ni | 25–35 |
| Mo | 3–6 |
| Mn | 3–6 |
| N | 0.20–0.40 |
| C | up to 0.05 |
| Si | up to 1.0 |
| S | up to 0.02 |
| Cu | up to 1.5 |

the balance iron and normally occurring impurities and additions.

2. The alloy of claim 1, wherein the content of nickel is at least 26 weight-%.

3. The alloy of claim 1, wherein the content of nickel is at least 28 weight-%.

4. The alloy of claim 1, wherein the content of nickel is at least 31–34 weight-%.

5. The alloy of claim 1, wherein the content of molybdenum is 4.0–6.0 weight-%.

6. The alloy of claim 5, wherein the content of molybdenum is 4.0–5.5 weight-%.

7. The alloy of claim 1, wherein the content of manganese is 4–6 weight-%.

8. The alloy of claim 1, wherein the content of Nitrogen is 0.35–0.40 weight-%.

9. The alloy of claim 1, wherein the content of Chromium is 23–28 weight-%.

10. The alloy of claim 9, wherein the content of Chromium is 24–28 weight-%.

11. The alloy of claim 1, wherein the content of Molybdenum is partly replaced by Tungsten, where at least 2 weight-% Molybdenum is present.

12. The austenitic alloy of claim 1, wherein the alloy contains a ductility addition which comprises of one or more of the elements Mg, Ce, Ca, B, La, Pr, Zr, Ti, Nd in a total amount of highest 0.2 weight-%.

13. The alloy of claim 1, wherein the content of copper is at least 0.011 weight %.

14. The alloy of claim 1, wherein the content of copper is at least 0.025 weight %.

15. The alloy of claim 1, wherein the content of copper is at least 0.5 weight %.

16. The alloy of claim 1, wherein the content of copper is at least 1.15 weight %.

17. The alloy of claim 1, wherein the content of copper is at least 1.16 weight %.

18. The alloy of claim 1, wherein the content of copper is at least 1.18 weight %.

19. The alloy of claim 1, wherein the content of copper is at least 1.48 weight %.

* * * * *